US007538298B2

(12) United States Patent
Li

(10) Patent No.: US 7,538,298 B2
(45) Date of Patent: May 26, 2009

(54) GAS REMOVING APPARATUS FOR HEAT PIPE

(76) Inventor: Jia-Hao Li, No. 2, Lane 127, Dang Ke St., Kang Shan Jen, Kao Hsiung Hsien (TW)

( * ) Notice: Subject to any disclaimer, the term of this patent is extended or adjusted under 35 U.S.C. 154(b) by 824 days.

(21) Appl. No.: 11/000,961

(22) Filed: Dec. 2, 2004

(65) Prior Publication Data

US 2006/0117557 A1 Jun. 8, 2006

(51) Int. Cl.

| | |
|---|---|
| ***B21D 53/06*** | (2006.01) |
| ***B21D 21/00*** | (2006.01) |
| ***B23K 31/00*** | (2006.01) |
| ***F28D 15/00*** | (2006.01) |

(52) U.S. Cl. ..... 219/385; 219/201; 219/243; 29/890.032; 29/890.053; 165/104.21; 165/104.32

(58) Field of Classification Search ..... None
See application file for complete search history.

(56) References Cited

U.S. PATENT DOCUMENTS

| | | | | |
|---|---|---|---|---|
| 2,733,849 | A * | 2/1956 | Trenchard | 219/243 |
| 4,106,171 | A * | 8/1978 | Basiulis | 29/890.032 |
| 6,230,407 | B1 * | 5/2001 | Akutsu | 29/890.032 |
| 2004/0194311 | A1 * | 10/2004 | Hsu | 29/890.032 |

* cited by examiner

*Primary Examiner*—Joseph M Pelham

(57) ABSTRACT

A gas removing apparatus for heat pipe can be used in a plurality of heat pipes arranged in a row or used for single semi-finished heat pipe. The gas removing apparatus includes a heating unit and a sealing unit. The heating unit is used for heating the heat pipe. The sealing unit is placed atop the heating unit and outside an opening of the heat pipe. The sealing unit includes a sealing die and a sealing mechanism for opening and closing the sealing die. The heating unit includes two heating plates arranged in parallel and separated with each other by a predetermined distance such that an accommodating space is defined between the separated heating plates. The heat pipes are placed between the two heating plates and the two heating plates heat the heat pipes through radiation and convection.

16 Claims, 5 Drawing Sheets

GAS REMOVING APPARATUS FOR HEAT PIPE

BACKGROUND OF THE INVENTION

1. Field of the Invention

The present invention relates to a gas removing apparatus for heat pipe, and more particularly to a gas removing apparatus for removing non-condensate gas from a plurality of heat pipes simultaneously.

2. Description of Prior Art

The conventional hear pipe generally includes means to remove non-condensate gas therein. For example, Taiwan patent gazette No. 593961 discloses a method and an apparatus to remove non-condensate gas in a heat pipe. However, the apparatus to remove non-condensate gas in above patent has heating means for only one heat pipe for removing gas therein. Thus apparatus is not suitable for mass-produced heat pipe. Moreover, the heating means is clamped to the heat pipe with large contact area. The wall of heat pipe has risk of damage and the performance of the heat pipe may be deteriorated if the heat pipe has non-ideal size or the heating means has non-ideal design.

SUMMARY OF THE INVENTION

The present invention is to provide a gas removing apparatus for heat pipe. The heating unit heats the heat pipes through thermal radiation to remove non-condensate gas in a heat pipe or a plurality of heat pipes. Moreover, the heat pipe does not need clamping process during heating. The defect of heat pipe such as asymmetry, bending, and distortion, and imprecise machine will not influence the performance of the heat pipe.

Accordingly, the present invention provides a gas removing apparatus for heat pipe. The gas removing apparatus can be used in a plurality of heat pipes arranged in a row or used for single semi-finished heat pipe. The gas removing apparatus comprises a heating unit and a sealing unit. The heating unit is used for heating the heat pipe. The sealing unit is placed atop the heating unit and outside an opening of the heat pipe. The sealing unit comprises a sealing die and a sealing mechanism for opening and closing the sealing die. The heating unit comprises two heating plates arranged in parallel and separated with each other by a predetermined distance such that an accommodating space is defined between the separated heating plates. The heat pipes are placed between the two heating plates and the two heating plates heat the heat pipes through radiation and convection.

The above summaries are intended to illustrate exemplary embodiments of the invention, which will be best understood in conjunction with the detailed description to follow, and are not intended to limit the scope of the appended claims.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
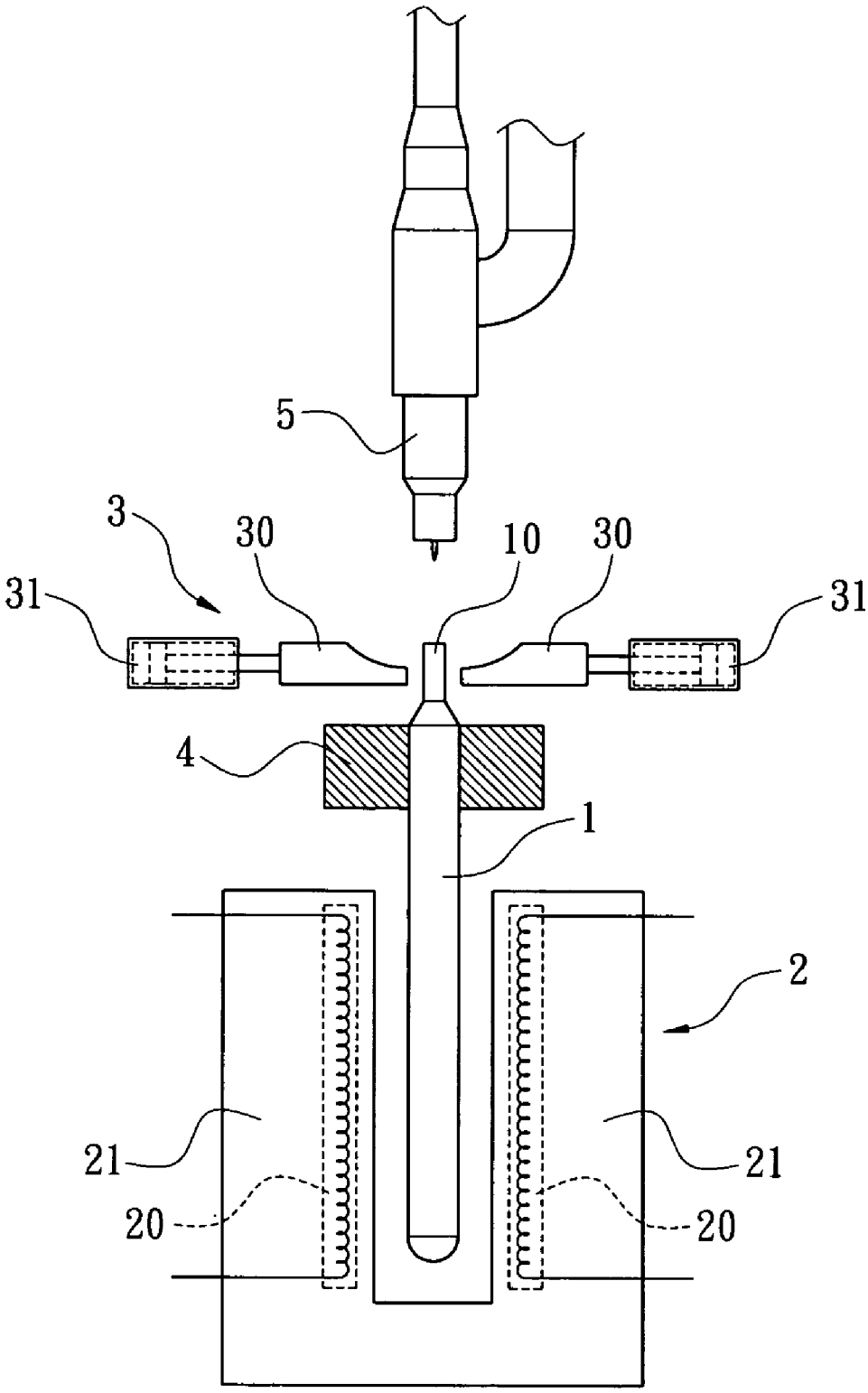
FIG. 1 shows a sectional view of a preferred embodiment according to the present invention.
Figure 2:
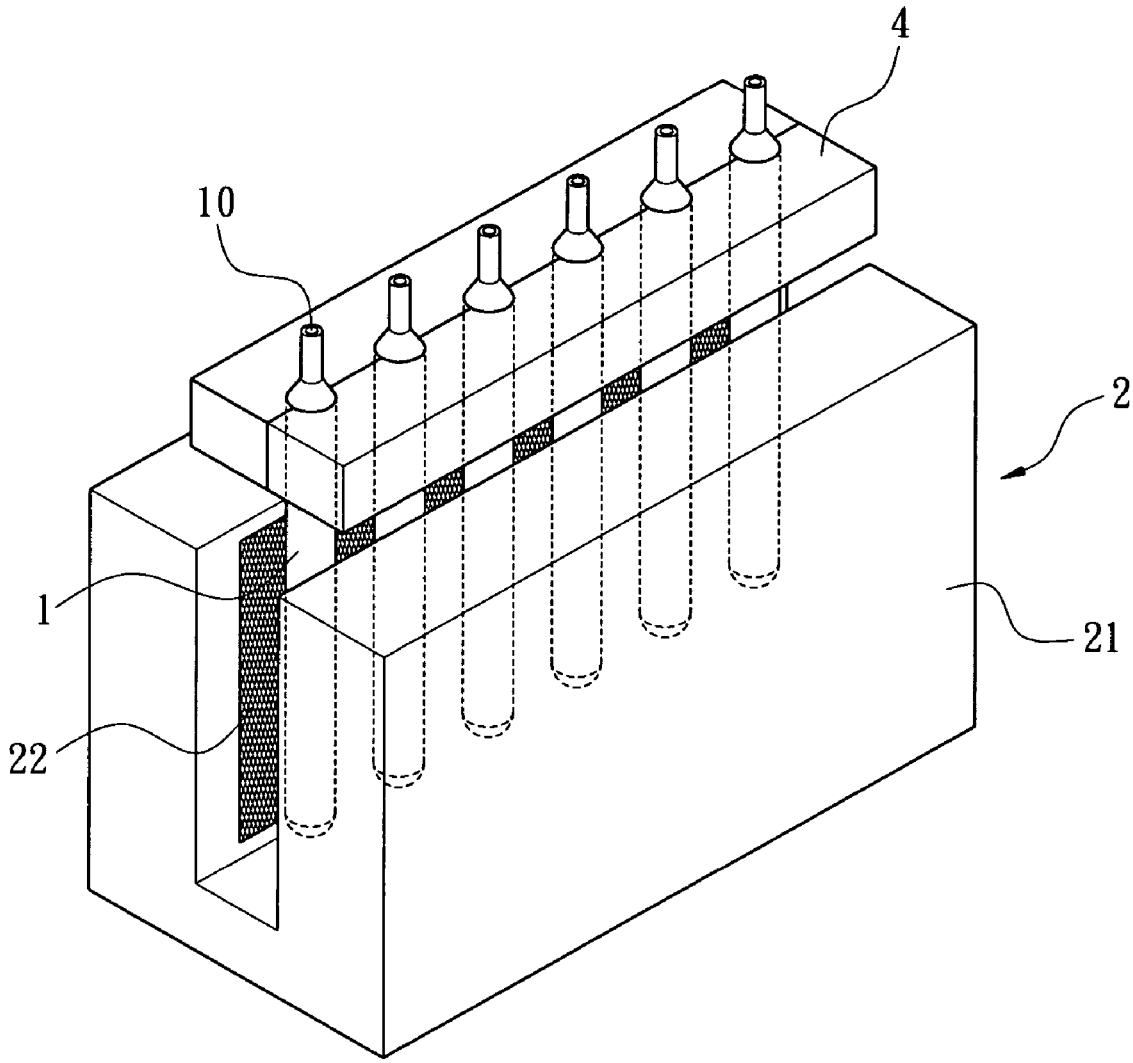
FIG. 2 shows a perspective view of the heating unit of the present invention.
Figure 3:
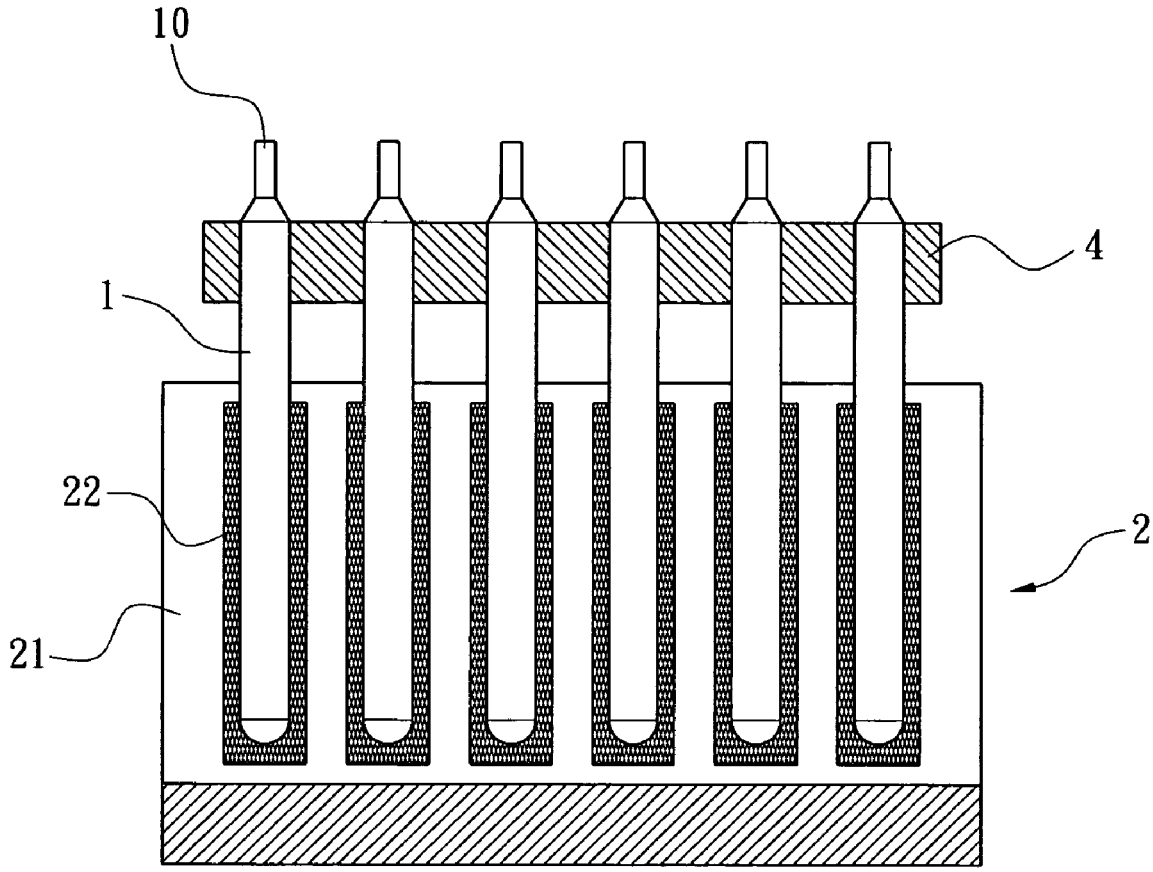
FIG. 3 shows a sectional view of the heating unit of the present invention.

Please refer to FIG. 1 through FIG. 3 according to a preferred embodiment of the present invention. As shown in those figures, the present invention provides a gas removing apparatus for heat pipe, which can be used in a plurality of heat pipes 1 arranged in a row or used for single semi-finished heat pipe 1. The gas removing apparatus for heat pipe according to the present invention comprises a heating unit 2 and a sealing unit 3.

The heating unit 2 comprises a heater 20 for controlling heating amount and temperature. The heating unit 2 is arranged on both sides of the heat pipe 1 for providing heating to the heat pipe 1.

The sealing unit 3 comprises a sealing die 30 and a sealing mechanism 31 for opening and closing the sealing die 30. Moreover, the sealing unit 3 is arranged atop the heating unit 2 and outside the opening of the heat pipe 1, which is to be sealed. The opening is functioned as gas vent 10 for removing non-condensate gas for the heat pipe 1. Moreover, the sealing die 30 has heater (not shown) with controlled temperature to ensure that the temperature nearby is higher than the saturated temperature during sealing operation.

The heating unit 2 according to the present invention comprises two heating plates 21 arranged in parallel and separated with each other by a predetermined distance such that an accommodating space is defined between the separated heating plates 21. The heat pipes 1 are arranged in the accommodating space and not in contact with the two heating plates 21. Each of the two heating plates 21 is provided with the heater 20 and the two heaters 20 are opposite to each other. Moreover, heating meshes 22 are arranged on two facing surfaces of the heating plates 21. Therefore, the heat generated by the heater 20 can heat the heat pipe 1 through radiation and convection.

Moreover, the two heating plates 21 are connected through bottom portions thereof such that the heating unit 2 has U-shaped cross section. This structure prevents the heat dissipation from bottom of the two heating plates 21. Moreover, this structure prevents external gas from flowing into the heating unit 2 to enhance the thermal stability of the heating unit 2. The heating energy is preserved between the two heating plates 21, thus saving electrical power.

Moreover, a clamping unit 4 for pipe end is provided below the sealing unit 3 and placed at upper circumference of the heat pipe 1 to clamp the heat pipe 1 in erected stand. The clamping unit 4 is configured to fit heat pipes 1 of different pipe dimension and can be provided with heater (not shown) with controlled temperature.

The gas removing apparatus for heat pipe according to the present invention provides can be configured and assembled according to above description.

Figure 4:
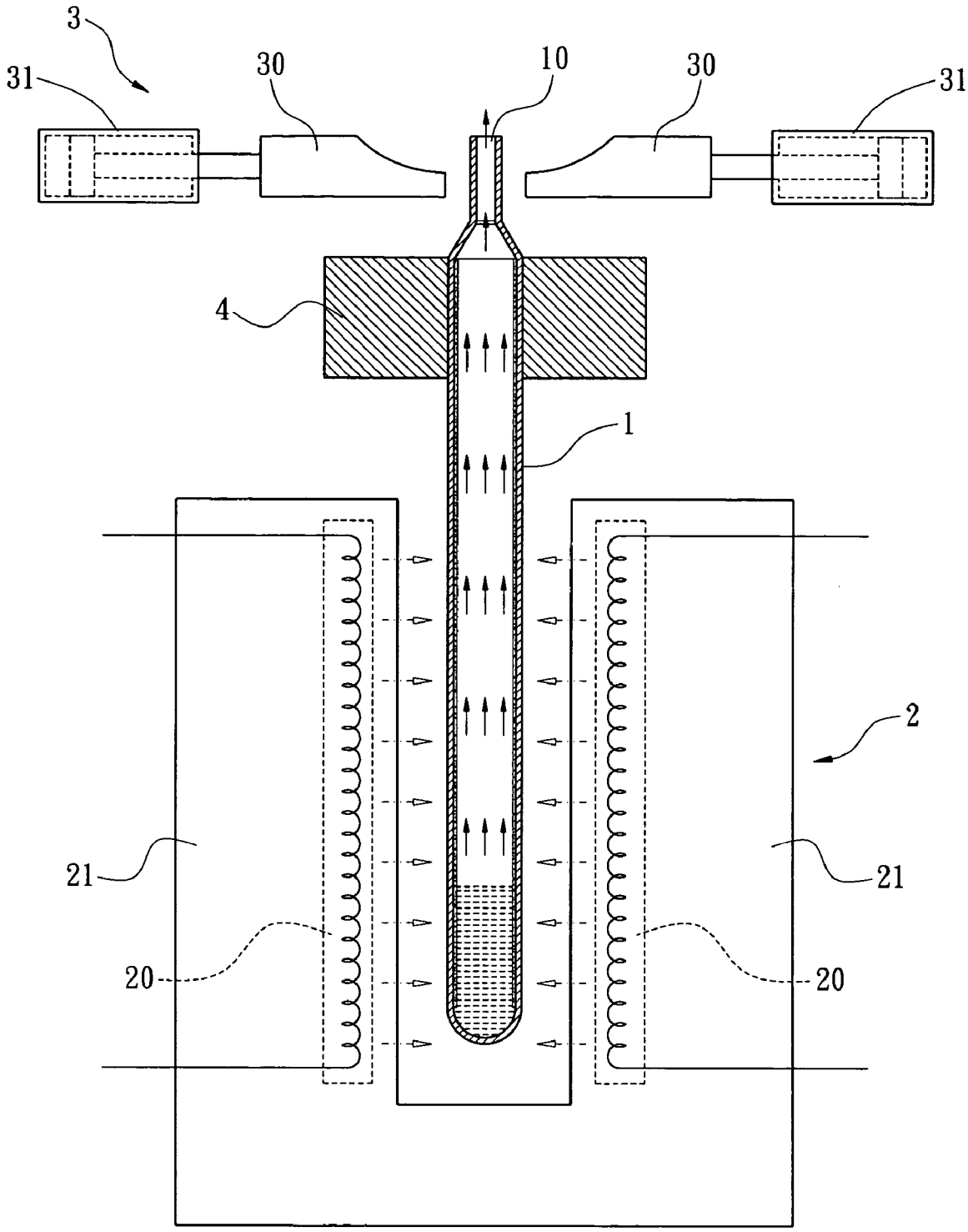
FIG. 4 is a sectional view depicting that the gas removing apparatus according to the present invention operates for a plurality of heat pipes.
Figure 5:
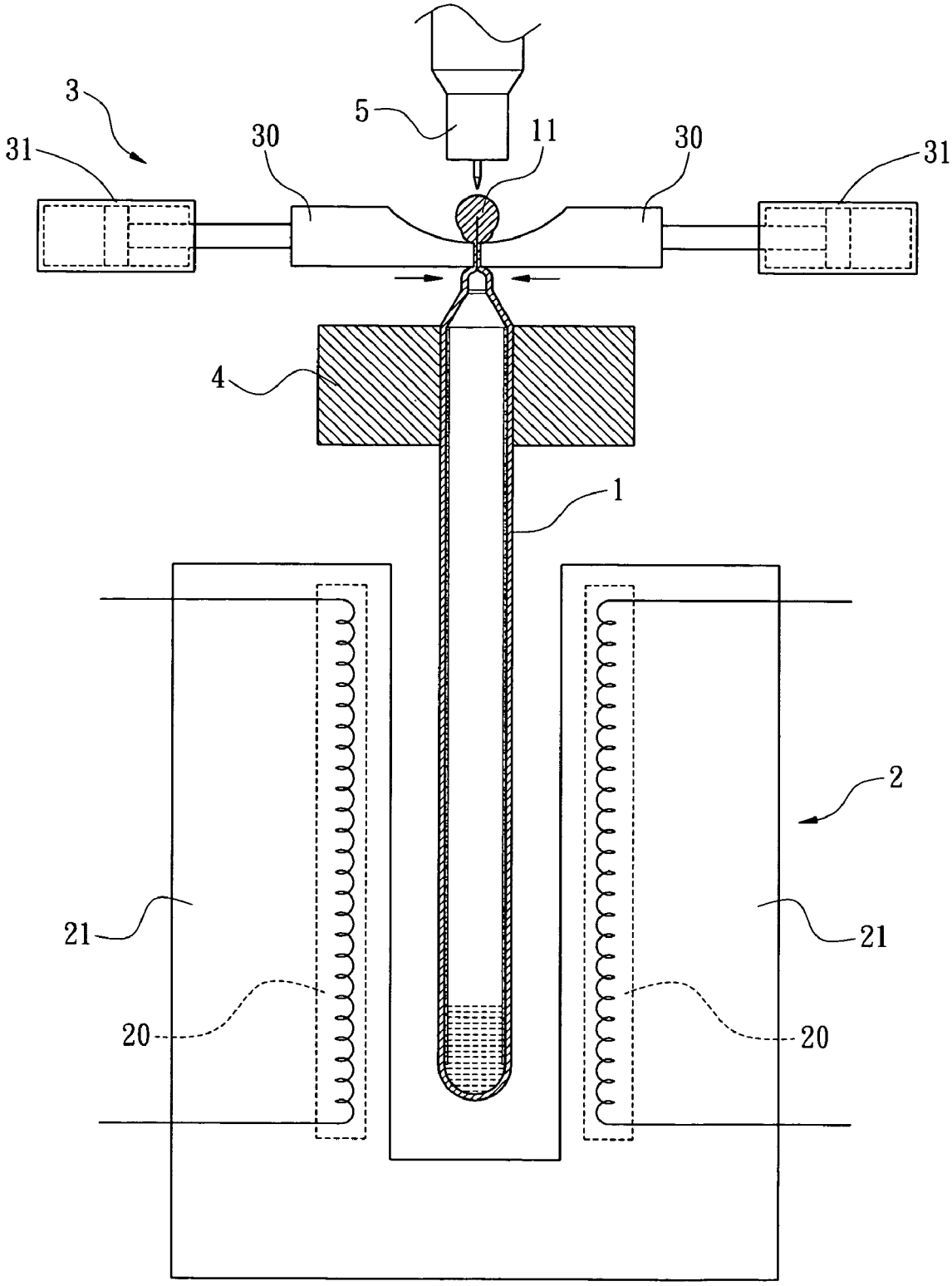
FIG. 5 is another sectional view depicting that the gas removing apparatus according to the present invention operates for a plurality of heat pipes.

FIGS. 4 and 5 are sectional views depicting that the gas removing apparatus according to the present invention operates for a plurality of heat pipes 1. The heat pipes 1 are filled with working fluid when the heat pipes 1 are subjected to gas removing operation. Moreover, the heat pipes 1 are arranged in a line between the two heating plates 21 and clamped by the clamping unit 4 at pipe end thereof (as shown in FIGS. 2 and 3). Moreover, a gas vent 10 is defined at top of the heat pipe 1 as shown in FIG. 4 and two heating plates 21 heat the heat pipes 1 through thermal radiation and convection to raise temperature of the working fluid when the gas vent 10 is still in opened state.

When the working fluid reaches saturated temperature, the saturated temperature is kept until the working fluid boils and evaporates. The non-condensate gas within the pipe 1 is expelled by the evaporated fluid. The sealing unit 3 performs sealing process to the vent 10 of the heat pipe 10 when desired degas amount reaches. At this time, the spot welding unit 5 atop the sealing unit 3 performs spot welding to the vent 10 to form a sealed structure 11 as shown in FIG. 5, thus finishing degas and sealing operation for the heat pipe.

In the gas removing apparatus for heat pipe according to the present invention, the heating unit heats the heat pipes 1 through thermal radiation to remove non-condensate gas in a heat pipe or a plurality of heat pipes. Moreover, the heat pipe does not need clamping process during heating. The defect of heat pipe such as asymmetry, bending, and distortion, and imprecise machine will not influence the performance of the heat pipe.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A gas removing apparatus for a heat pipe, comprising a heating unit for heating the heat pipe; and a sealing unit placed atop the heating unit and outside an opening of the heat pipe, comprising a sealing die and a sealing mechanism for opening and closing the sealing die;

wherein the heating unit comprises two heating plates arranged in parallel and separated with each other by a predetermined distance such that an accommodating space is defined between the separated heating plates, and wherein the heat pipe is placed between the two heating plates and the two heating plates heat the heat pipe through radiation and convection, and the heating plates having heating meshes on facing surfaces thereof.

2. The gas removing apparatus for heat pipe as in claim 1, wherein the two heating plates are connected at bottom thereof such that the heating unit has U-shaped cross section.

3. The gas removing apparatus for heat pipe as in claim 1, wherein the heating plates have heaters with controlled temperature.

4. The gas removing apparatus for heat pipe as in claim 1, wherein the sealing unit comprises a sealing die and a sealing mechanism for opening and closing the sealing die.

5. The gas removing apparatus for heat pipe as in claim 4, wherein the sealing die has heater with controlled temperature.

6. The gas removing apparatus for heat pipe as in claim 1, further comprising a clamping unit for pipe end below the sealing unit.

7. The gas removing apparatus for heat pipe as in claim 6, wherein the clamping unit has heater with controlled temperature.

8. The gas removing apparatus for heat pipe as in claim 1, further comprising a spot welding unit atop the sealing unit.

9. A gas removing apparatus for a heat pipe, comprising a heating unit for heating the heat pipe without directly contacting to the heat pipe;

a sealing unit placed atop the heating unit and outside an opening of the heat pipe, comprising a sealing die and a sealing mechanism for opening and closing the sealing die; and a clamping unit for clamping an end of the heat pipe below the sealing unit, the clamping unit being spaced apart from the heating unit;

wherein the heating unit comprises two heating plates arranged in parallel and separated with each other by a predetermined distance such that an accommodating space is defined between the separated heating plates.

10. The gas removing apparatus for heat pipe as in claim 9, wherein the two heating plates are connected at bottom thereof such that the heating unit has U-shaped cross section.

11. The gas removing apparatus for heat pipe as in claim 9, wherein the heating plates have heaters with controlled temperature.

12. The gas removing apparatus for heat pipe as in claim 9, wherein the heating plates have heating meshes on facing surfaces thereof.

13. The gas removing apparatus for heat pipe as in claim 9, wherein the sealing unit comprises a sealing die and a sealing mechanism for opening and closing the sealing die.

14. The gas removing apparatus for heat pipe as in claim 13, wherein the sealing die has heater with controlled temperature.

15. The gas removing apparatus for heat pipe as in claim 14, wherein the clamping unit has heater with controlled temperature.

16. The gas removing apparatus for heat pipe as in claim 9, further comprising a spot welding unit atop the sealing unit.

* * * * *